US005901417A

United States Patent [19]

Alexiou

[11] Patent Number: 5,901,417

[45] Date of Patent: May 11, 1999

[54] BUTTON PROTECTOR

[76] Inventor: Charalambos Alexiou, 35 Babbacombe Road, Bromley, Kent BR1 3LN, United Kingdom

[21] Appl. No.: 09/095,976

[22] Filed: Jun. 11, 1998

[51] Int. Cl.[6] ..... A44B 1/00

[52] U.S. Cl. ..... 24/90.5; 24/113 MP

[58] Field of Search ..... 24/113 R, 113 MP, 24/90.5, 114.9

[56] References Cited

U.S. PATENT DOCUMENTS

| | | | |
|---|---|---|---|
| 138,745 | 5/1873 | Freeman | 24/90.5 |
| D. 396,202 | 7/1998 | Lindsay | 24/90.5 X |
| 417,016 | 12/1889 | Gaynor | 24/113 R X |
| 3,757,388 | 9/1973 | Wolny | 24/113 MP |
| 4,539,731 | 9/1985 | Torrini | 24/113 MP X |
| 5,621,951 | 4/1997 | Gould | 24/90.5 |

*Primary Examiner*—James R. Brittain

[57] ABSTRACT

A new button protector for protecting a button on an article of clothing from breakage and other damage, especially when washing the article of clothing. The inventive device includes a housing having an interior space adapted for receiving a button on a garment therein. The housing comprises a pair of separable sections pivotally coupled together to provide an opening into the interior space of the housing. The panels of the housing each have a slot extending therethrough for extending the threading holding a button to a garment.

9 Claims, 2 Drawing Sheets

BUTTON PROTECTOR

BACKGROUND OF THE INVENTION

1. Field of the Invention

The present invention relates to devices for protecting buttons on clothing from breakage and other damage and more particularly pertains to a new button protector for protecting a button on an article of clothing from breakage and other damage, especially when washing the article of clothing.

2. Description of the Prior Art

The use of devices for protecting buttons on clothing from breakage and other damage is known in the prior art. More specifically, devices for protecting buttons on clothing from breakage and other damage heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for protecting buttons on clothing from breakage and other damage include U.S. Pat. No. 5,263,853; U.S. Pat. No. 4,803,858; U.S. Pat. No. Des. 344,456; U.S. Pat. No. 5,008,551; U.S. Pat. No. 3,010,124; and U.S. Pat. No. 1,464,745.

While these devices fulfill their respective, particular objectives and requirements, the aforementioned patents do not disclose a new button protector. The inventive device includes a housing having an interior space adapted for receiving a button on a garment therein. The housing comprises a pair of separable sections pivotally coupled together to provide an opening into the interior space of the housing. The panels of the housing each have a slot extending therethrough for extending the threading holding a button to a garment.

In these respects, the button protector according to the present invention substantially departs from the conventional concepts and designs of the prior art, and in so doing provides an apparatus primarily developed for the purpose of protecting a button on an article of clothing from breakage and other damage, especially when washing the article of clothing.

SUMMARY OF THE INVENTION

In view of the foregoing disadvantages inherent in the known types of devices for protecting buttons on clothing from breakage and other damage now present in the prior art, the present invention provides a new button protector construction wherein the same can be utilized for protecting a button on an article of clothing from breakage and other damage, especially when washing the article of clothing.

The general purpose of the present invention, which will be described subsequently in greater detail, is to provide a new button protector apparatus and method which has many of the advantages of the devices for protecting buttons on clothing from breakage and other damage mentioned heretofore and many novel features that result in a new button protector which is not anticipated, rendered obvious, suggested, or even implied by any of the prior art devices for protecting buttons on clothing from breakage and other damage, either alone or in any combination thereof.

To attain this, the present invention generally comprises a housing having an interior space adapted for receiving a button on a garment therein. The housing comprises a pair of separable sections pivotally coupled together to provide an opening into the interior space of the housing. The panels of the housing each have a slot extending therethrough for extending the threading holding a button to a garment.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new button protector apparatus and method which has many of the advantages of the devices for protecting buttons on clothing from breakage and other damage mentioned heretofore and many novel features that result in a new button protector which is not anticipated, rendered obvious, suggested, or even implied by any of the prior art devices for protecting buttons on clothing from breakage and other damage, either alone or in any combination thereof.

It is another object of the present invention to provide a new button protector which may be easily and efficiently manufactured and marketed.

It is a further object of the present invention to provide a new button protector which is of a durable and reliable construction.

An even further object of the present invention is to provide a new button protector which is susceptible of a low cost of manufacture with regard to both materials and labor, and which accordingly is then susceptible of low prices of sale to the consuming public, thereby making such button protector economically available to the buying public.

Still yet another object of the present invention is to provide a new button protector which provides in the apparatuses and methods of the prior art some of the advantages thereof, while simultaneously overcoming some of the disadvantages normally associated therewith.

Still another object of the present invention is to provide a new button protector for protecting a button on an article of clothing from breakage and other damage, especially when washing the article of clothing.

Yet another object of the present invention is to provide a new button protector which includes a housing having an interior space adapted for receiving a button on a garment therein. The housing comprises a pair of separable sections pivotally coupled together to provide an opening into the interior space of the housing. The panels of the housing each have a slot extending therethrough for extending the threading holding a button to a garment.

Still yet another object of the present invention is to provide a new button protector that is easy to attach to a button on garment to protect the button while washing the garment and that is easy to detach from the button after washing Even still another object of the present invention is to provide a new button protector that may be used to protect various sorts of fasteners on garments and not necessarily limited to protecting solely buttons on a garment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
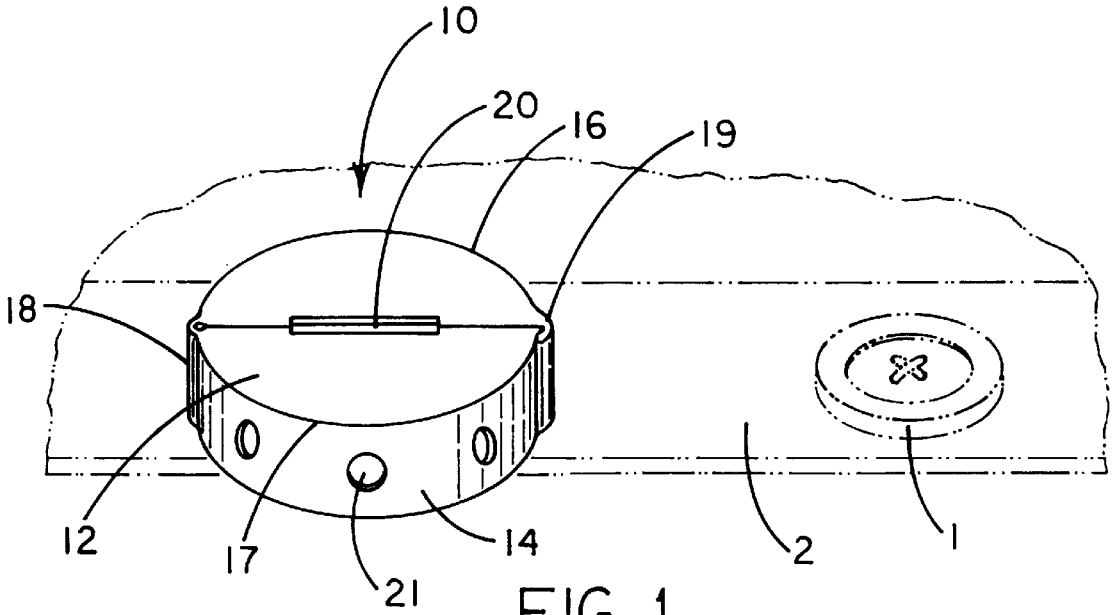
FIG. 1 is a schematic perspective view of a new button protector according to the present invention in use covering a button on a garment.

With reference now to the drawings, and in particular to FIGS. 1 through 5 thereof, a new button protector embodying the principles and concepts of the present invention and generally designated by the reference numeral 10 will be described.

As best illustrated in FIGS. 1 through 5, the button protector 10 generally comprises a housing having an interior space 15 adapted for receiving a button 1 on a garment 2 therein. The housing comprises a pair of separable sections 16,17 pivotally coupled together to provide an opening into the interior space 15 of the housing. The panels 12,13 of the housing each have a slot 20 extending therethrough for extending the threading holding a button 1 to a garment 2.

Commonly, when washing garments, especially commercially, buttons and other fasteners on the garment become damaged or broken. In use, the protective cover 10 is designed for covering a button 1 or another fastener on a garment 2 so that the button does not become damaged during the cleaning process. In closer detail, the protective housing 10 has a pair spaced apart panels 12,13 and a perimeter side wall 14 extending between the panels 12,13, the panels 12,13 and the perimeter side wall 14 defining an interior space 15 of the housing. The interior space 15 is designed for receiving a button 1 on a garment 2 therein.

As illustrated in the Figures, the housing 10 is formed from a pair of separable sections 16,17 each having a portion of each of the panels 12,13 and a portion of the perimeter side wall 14. The portions of the perimeter side wall 14 of the separable sections 16,17 are pivotally coupled together such that the separable sections 16,17 are pivotable between a closed position (FIG. 2) and an open position (FIG. 3). Ideally, the housing 10 has a living hinge 18 pivotally coupling the portions of the perimeter side wall of the separable sections 16,17 together. As illustrated in FIG. 3, the separable sections 16,17 form an opening into the interior space 15 of the housing when the separable sections 16,17 are pivoted towards the open portion.

Figure 5:
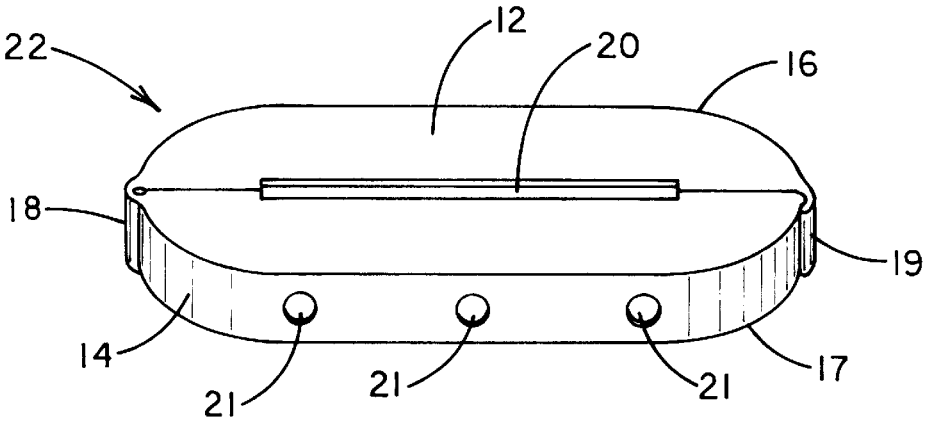
FIG. 5 is a schematic perspective view of an additional embodiment of the present invention.

Preferably as shown in FIGS. 1 through 4, each of the panels 12,13 of the housing is generally circular such that the housing is generally cylindrical and such that the portions of the panels 12,13 of each the separable sections 16,17 of the housing are semi-circular. In an additional embodiment 22, the panels 12,13 of the housing are generally oblong as shown in FIG. 5 so that the housing 10 may cover elongated fasteners or multiple buttons on a garment such as a pair of buttons on the cuff of a sleeve of a shirt. It should also be recognized that the shape of the housing may also be rectangular in shape, however, rounded shapes are preferred because they help prevent causing pulls and tears in garment when used during cleaning.

Figure 2:
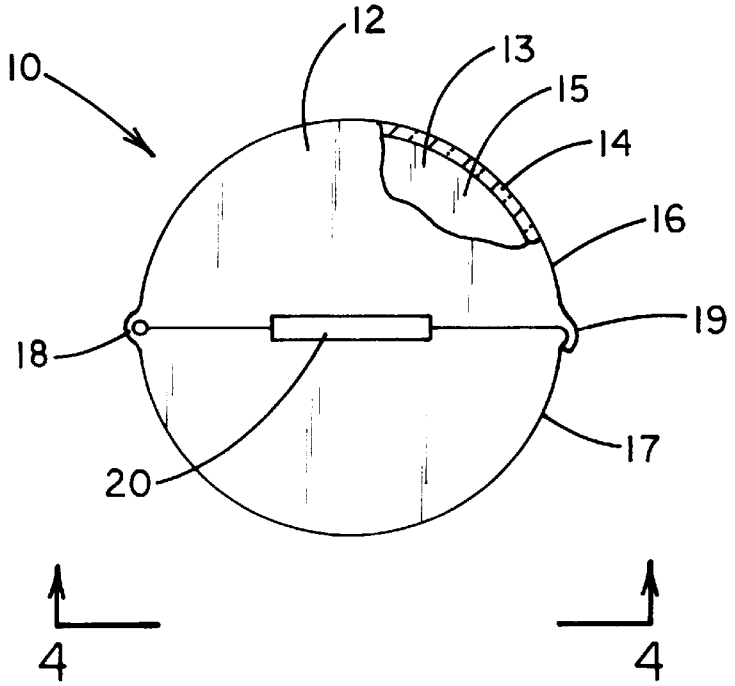
FIG. 2 is a schematic side view of the present invention in the closed position.
Figure 3:
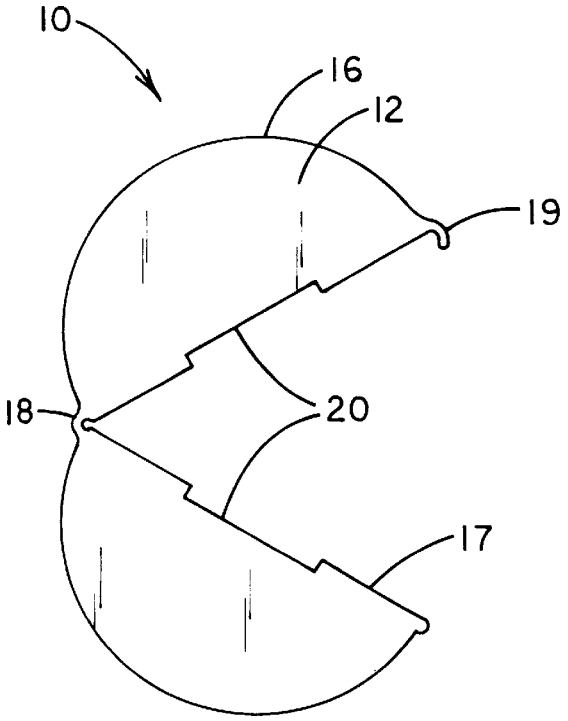
FIG. 3 is a schematic side view of the present invention in an open position.
Figure 4:
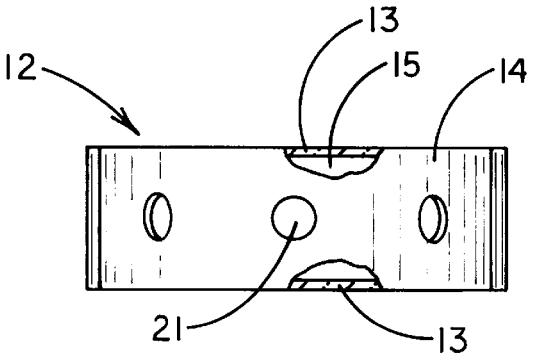
FIG. 4 is a schematic partial breakaway view of the present invention.

In a preferred embodiment, the housing 10 has a catch 19 for releasably holding the portions of the perimeter side wall 14 of the separable sections 16,17 when the separable sections 16,17 are in the closed position as shown in FIG. 2. Preferably, the catch 19 of the housing releasably holds the portions of the perimeter side wall 14 of the separable sections 16,17 at a point diametrically opposite pivotal coupling 18 of the portions of the perimeter side wall 14 of the separable sections 16,17.

The panels 12,13 of the housing each have a slot 20 extending therethrough. The periphery of each of the slots 20 is preferably generally rectangular. Also preferably, each of the slots 20 is centrally positioned on the associated panel of the housing. The slots 20 are designed for extending the threads holding a button 1 to a garment 2 when a button is disposed in the interior space 15 of the housing. As illustrated in FIG. 3, each of the separable sections 16,17 of the housing has a portion of the periphery of each of the slots 20 such that each of the separable sections 16,17 of the housing has a portion of each the slots 20. Ideally, the length of each of the slots 20 is extended along the diameter of the associated panel of the housing. With reference to FIG. 5, in the additional embodiment 22, preferably, the length of each of the slot 20*s* is extended parallel to the length of the oblong shaped panels 12,13 of the housing.

Preferably, the perimeter side wall 14 of the housing has a plurality of spaced apart holes 21 therethrough. The holes 21 are designed for providing vent openings into the interior space 15 of the housing. Ideally, each of the holes 21 of the perimeter side wall 14 of the housing has a generally circular periphery.

In use, the sections 16,17 of the housing are pivoted to the open position to permit insertion of a button 1 into the interior space 15. The housing is positioned around the button so that the threads holding the button to the garment 2 will extend through on of the slots 20 in the panel facing the garment. The sections are then pivoted to the closed position and held in the closed position with the catch 19 so that the housing 10 covers the button on the garment to protect the button from damage during cleaning of the garment.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A protective cover for covering a button on a garment, said protective cover comprising:

a housing having a pair spaced apart panels and a perimeter side wall extending between said panels, said panels and said perimeter side wall defining an interior space of said housing;

said housing comprising a pair of separable sections, each of said separable sections of said housing having a portion of each of said panels of said housing and a portion of said perimeter side wall of said housing;

said portions of said perimeter side wall of said separable sections being pivotally coupled together such that said separable sections are pivotable between a closed position and an open position;

wherein said separable sections form an opening into said interior space of said housing when said separable sections are pivoted towards said open portion; and said panels of said housing each having a slot extending therethrough, each of said slots having a periphery, each of said separable sections of said housing having a portion of the periphery of each of said slots such that each of said separable sections of said housing has a portion of each said slots;

wherein said periphery of each of said slots is generally rectangular.

2. The protective cover of claim 1, wherein said housing has a living hinge portion pivotally coupling said portions of said perimeter side wall of said separable sections together.

3. The protective cover of claim 1, wherein said housing has a catch for releasably holding said portions of said perimeter side wall of said separable sections when said separable sections are in said closed position.

4. The protective cover of claim 3, wherein each of said panels of said housing is generally circular such that said housing is generally cylindrical and such that said portions of said panels of each said separable sections of said housing are semi-circular, each of said panels of said housing having a diameter.

5. The protective cover of claim 4, wherein said catch of said housing releasably holds said portions of said perimeter side wall of said separable sections at a point diametrically opposite pivotal coupling of said portions of said perimeter side wall of said separable sections.

6. The protective cover of claim 1, wherein each of said slots is centrally positioned on the associated panel of said housing.

7. The protective cover of claim 1, wherein each of said panels of said housing is generally circular and each has a diameter, wherein each of said slots has a length, said length of each of said slots being extended along the diameter of the associated panel of said housing.

8. The protective cover of claim 1, wherein said perimeter side wall of said housing has a plurality of spaced apart holes therethrough.

9. A protective cover for covering a button on a garment, said protective cover comprising:

a housing having a pair spaced apart panels and a perimeter side wall extending between said panels, said panels and said perimeter side wall defining an interior space of said housing;

said housing comprising a pair of separable sections, each of said separable sections of said housing having a portion of each of said panels of said housing and a portion of said perimeter side wall of said housing;

said portions of said perimeter side wall of said separable sections being pivotally coupled together such that said separable sections are pivotable between a closed position and an open position, wherein said housing has a living hinge portion pivotally coupling said portions of said perimeter side wall of said separable sections together;

wherein said separable sections form an opening into said interior space of said housing when said separable sections are pivoted towards said open portion;

said housing a having a catch for releasably holding said portions of said perimeter side wall of said separable sections when said separable sections are in said closed position;

wherein each of said panels of said housing is generally circular such that said housing is generally cylindrical and such that said portions of said panels of each said separable sections of said housing are semi-circular, each of said panels of said housing having a diameter;

said catch of said housing releasably holding said portions of said perimeter side wall of said separable sections at a point diametrically opposite pivotal coupling of said portions of said perimeter side wall of said separable sections;

said panels of said housing each having a slot extending therethrough, each of said slots having a periphery, said periphery of each of said slots being generally rectangular, each of said slots being centrally positioned on the associated panel of said housing;

each of said separable sections of said housing having a portion of the periphery of each of said slots such that each of said separable sections of said housing has a portion of each said slots;

each of said slots having a length, said length of each of said slots being extended along the diameter of the associated panel of said housing; and said perimeter side wall of said housing having a plurality of spaced apart holes therethrough, each of said holes of said perimeter side wall of said housing having a generally circular periphery.

* * * * *